US010499786B1

(12) United States Patent
Gary, Jr. et al.

(10) Patent No.: US 10,499,786 B1
(45) Date of Patent: Dec. 10, 2019

(54) HOUSEHOLD APPLIANCE INCLUDING A MOUNTABLE WIRELESS COMMUNICATION MODULE

(71) Applicant: WHIRLPOOL CORPORATION, Benton Harbor, MI (US)

(72) Inventors: Wyndham F. Gary, Jr., Whitefish Bay, WI (US); Jonathan D. Gephart, Saint Joseph, MI (US); John Howard Lanham, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/016,743

(22) Filed: Jun. 25, 2018

(51) Int. Cl.

| | |
|---|---|
| ***G05B 11/01*** | (2006.01) |
| ***A47L 15/00*** | (2006.01) |
| *A47L 15/42* | (2006.01) |

(52) U.S. Cl.
CPC ..... *A47L 15/006* (2013.01); *A47L 15/4295* (2013.01); *A47L 15/4297* (2013.01); *A47L 2401/10* (2013.01); *A47L 2401/12* (2013.01); *A47L 2401/19* (2013.01)

(58) Field of Classification Search
None
See application file for complete search history.

(56) References Cited

U.S. PATENT DOCUMENTS

| | | | | |
|---|---|---|---|---|
| 7,096,601 | B2 | 8/2006 | Lyu et al. | |
| 7,373,737 | B2 | 5/2008 | Lyu et al. | |
| 7,383,644 | B2 | 6/2008 | Lyu et al. | |
| 9,375,123 | B2 | 6/2016 | Bober et al. | |
| 9,510,723 | B2 * | 12/2016 | Cottrell | A47L 15/0018 |
| 9,924,849 | B2 | 3/2018 | Gary, Jr. et al. | |
| 2017/0055802 | A1 | 3/2017 | Cottrell et al. | |
| 2018/0103823 | A1 | 4/2018 | Gary, Jr. et al. | |

FOREIGN PATENT DOCUMENTS

| | | | |
|---|---|---|---|
| CN | 107581987 | A | 1/2018 |
| EP | 2596736 | A1 | 5/2013 |
| EP | 2630904 | B1 | 7/2016 |
| EP | 3045579 | A1 | 7/2016 |
| WO | 2017061962 | A1 | 4/2017 |
| WO | 2019007496 | A1 | 1/2019 |

OTHER PUBLICATIONS

Axel Kising, Patent Examiner, Extended European Search Report issued in related European Patent Application No. 19179695.2, 106 pages, dated Sep. 2, 2019, Munich, Germany.

* cited by examiner

*Primary Examiner* — Adolf Dsouza
(74) *Attorney, Agent, or Firm* — McGarry Bair PC

(57) ABSTRACT

A household appliance that includes a selectively mountable wireless communication module. The selectively mountable wireless communication module can be selectively mounted in a toe kick area of the household appliance. The household appliance can be, but is not limited to, a dishwasher, an oven, a refrigerator, a freezer, a microwave, a washing machine, a dryer, or a combo washer-dryer.

20 Claims, 7 Drawing Sheets

HOUSEHOLD APPLIANCE INCLUDING A MOUNTABLE WIRELESS COMMUNICATION MODULE

BACKGROUND

Users are increasingly interested in remote communication with household appliances, including dishwashers, in order to efficiently manage usage of the appliance. It is known to provide a household appliance, such as a dishwasher, with an antenna to facilitate remote communication. Providing a household appliance with an antenna is challenging because most household appliances are primarily constructed of metal that is electrically connected to earth ground, which acts as a large Faraday shield and does not allow wireless signals to escape the household appliance. Previous solutions have included mounting an antenna away from the household appliance, or mounting an antenna on one of the outside surfaces of the household appliance.

BRIEF DESCRIPTION

In one aspect, the disclosure relates to a dishwasher for treating dishes according to at least one automatic cycle of operation. The dishwasher can include a tub that at least partially defines a treating chamber with an access opening. The dishwasher can also include a door assembly movable between opened/closed positions to selectively open/close the access opening of the tub and a toe kick area along a bottom-front of the dishwasher wherein at least part of the door assembly overhangs the toe kick area. A first wireless communication mount can be located at a left side of the toe kick area and a second wireless communication mount can be located at a right side of the toe kick area. A wireless communication module that includes at least an antenna can be selectively mounted at either the first wireless communication mount or the second wireless communication mount. A controller can be configured to communicate with the wireless communication module.

Another aspect of the disclosure relates to a household appliance that includes a housing that defines an interior with a toe kick area along a bottom-front of the housing and a front overhanging the toe kick area. The household appliance can also include a controller located within the interior. A first wireless communication mount can be located at a left side of the toe kick area and a second wireless communication mount can be located at a right side of the toe kick area. A wireless communication module that includes at least an antenna can be selectively mounted in either the first wireless communication mount or the second wireless communication mount.

DESCRIPTION

Figure 1:
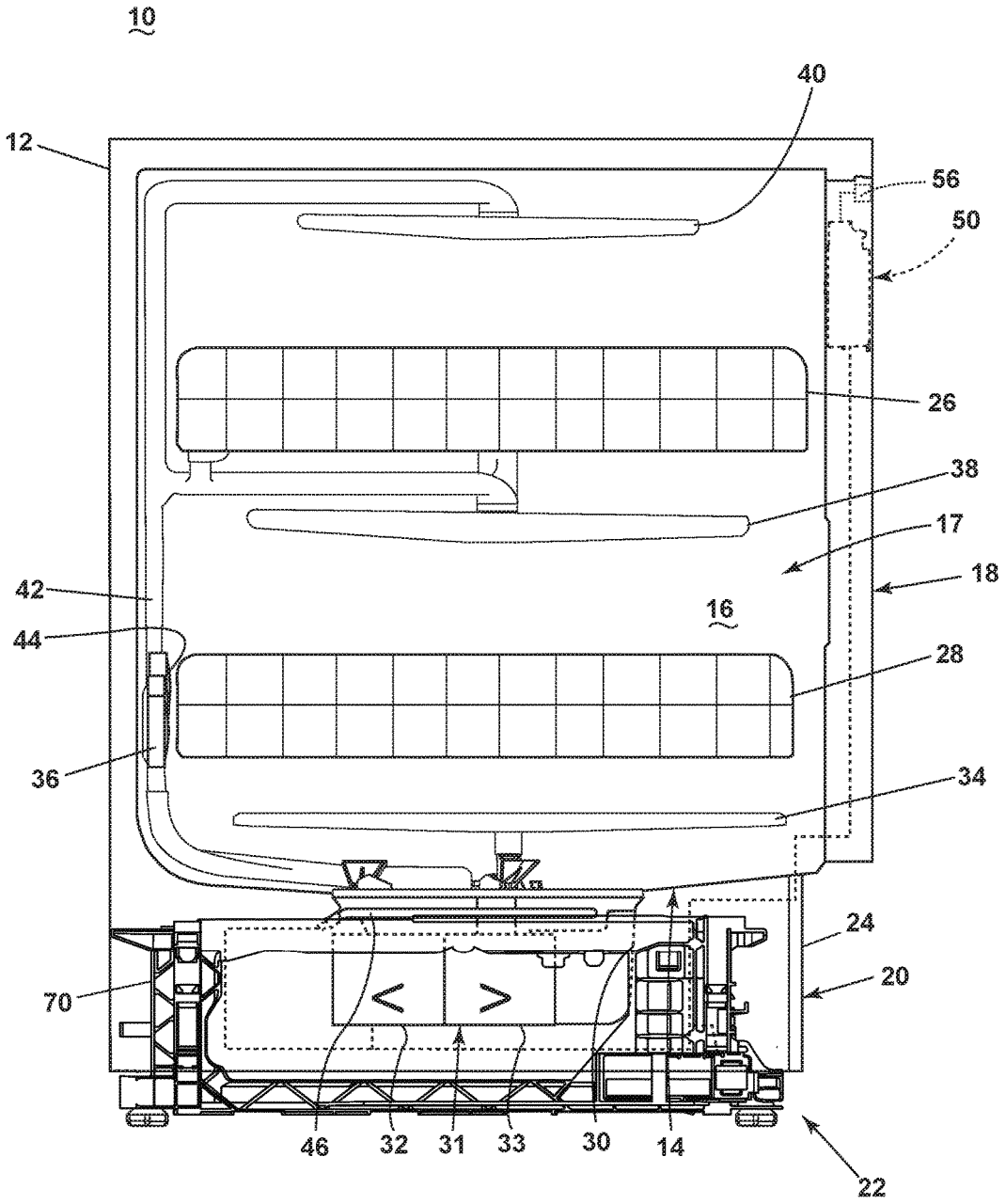
FIG. 1 is a schematic, cross-sectional view of a dishwasher in accordance with various aspects described herein, including a Wireless communication module located in either of two front corners behind a toe kick plate in a toe kick area.

Household appliances present a unique and difficult challenge for wireless communication, such as a WI-FI connection. Most household appliances have a major portion of which is metal, especially electrically-grounded metal, which functions as a Faraday cage to block the receipt/transmission of radio waves. In addition to the appliance itself blocking the wireless signal, the location of the appliance with respect to the wireless router or with respect to other appliances further compounds the problem. As there is no standardized location for wireless routers or appliances within a home, the problem is further compounded. Similarly, in the case of a kitchen installation, the non-standardized location of appliances can also compound the problem.

All other things being equal, the front side of the appliance is normally a better location for a wireless communication module than a rear side because the rear side of the appliance is normally against an exterior wall, and the metal portion of the household appliance lies between the rear wall and the interior of the home, where the wireless router is typically located, which would normally interfere with transmission into the interior of the house from a wireless communications module on the rear wall.

Of the front of the appliance, the lower toe-kick area provides a good location, from a design perspective, to locate the wireless module as the toe-kick area is not readily visible to the user, making it possible to make the toe-kick plate in the toe-kick area from a non-metal material without interfering with the visual aesthetic of a metal face (cabinet fronts, doors, etc.) found on most appliances.

Depending on the position of other appliances or the wireless router, one of the front corners tends to be better than the other for a specific home. Of course, which corner is better is not known until the appliance is installed. Thus, it is beneficial to provide a mounting location for the wireless communication module at both lower front corners, and let the installer determine which is best.

As many parts of an appliance, such as the base and/or feet, are made of metal, which could block part of the signal to/from the wireless communication module, it may be beneficial to make some of these historically metal parts out of a non-metal.

Therefore, the aspects of the present disclosure are generally directed to a selectively mountable wireless communication module for a household appliance, for example, a dishwasher. In order to provide optimal signal for a particular installation location, the wireless communication module can be mounted in a first or second wireless communication mount located in a toe-kick area of the household appliance.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, secured, fastened, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

In FIG. 1, an automated dishwasher 10 according to an aspect of the present disclosure is illustrated. The dishwasher 10 shares many features of a conventional automated dishwasher, which will not be described in detail herein except as necessary for a complete understanding. A chassis 12 can define an interior of the dishwasher 10 and can include a frame, with or without panels mounted to the frame. The chassis 12 can also include a base frame 70. By way of non-limiting example, the base frame 70 can be included in the chassis 12. An open-faced tub 14 can be provided within the base frame 70, such that the base frame 70 supports the tub 14. The tub 14 can at least partially define a treating chamber 16, having an open face, for washing dishes. A closure, or door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 can be secured to the lower front edge of the tub 14 via a hinge assembly (not shown) configured to pivot the door assembly 18 or to a portion of the chassis 12. When the door assembly 18 is closed, an access opening 17 to the treating chamber 16 can be closed, whereas the access opening 17 to the treating chamber 16 can be open when the door assembly 18 is open. The door assembly 18 overhangs a toe kick area 20 that is located along the bottom-front 22 of the dishwasher 10. The toe kick area 20 can include a toe kick plate 24. The toe kick plate 24 can be made of a material that is transparent to wireless communication signals and is therefore radio wave transmissive. A non-limiting example of a radio wave transmissive material that can be used to construct the toe kick plate 24 includes plastic.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper spray arm assembly 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and one or more recirculation pumps 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16. The household water supply can include a household cold water supply, household hot water supply, or a mixture as desired.

A heating system including a heating element 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door assembly 18 as illustrated. Alternatively the controller 50 can be located in the toe kick area 20 or somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
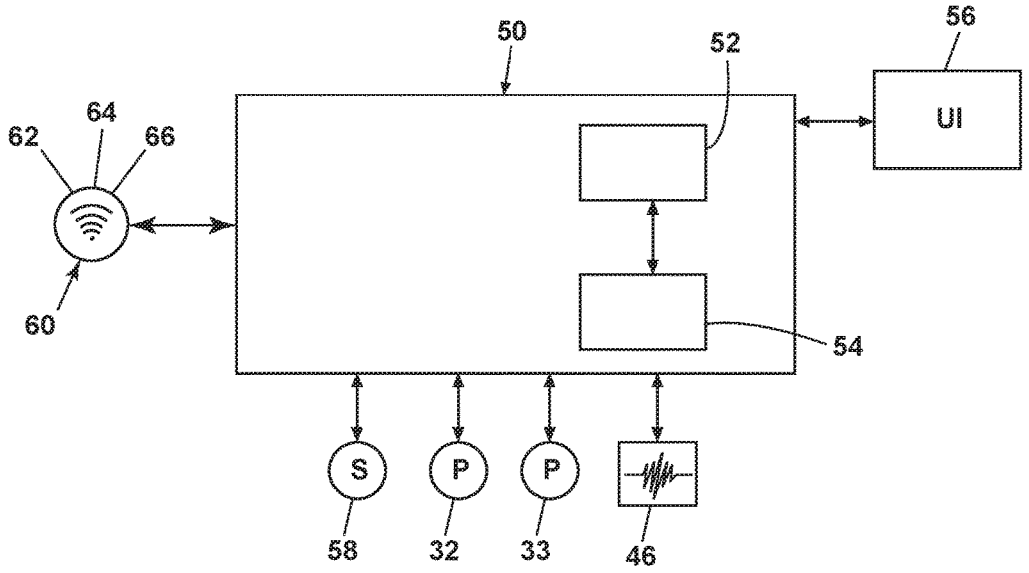
FIG. 2 is a schematic view of a controller of the dishwasher of FIG. 1.

As illustrated schematically in FIG. 2, the controller 50 can be coupled with the heating element 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor, humidity sensor, and turbidity sensor to determine the soil load associated with a selected grouping of dishes, such as the dishes associated with a particular area of the treating chamber 16. The controller 50 can also be configured to communicate with a wireless communication module 60. The wireless communication module 60 includes at least an antenna 62. The wireless communication module 60 can include, but is not limited to, a transmitter 64 and a receiver 66.

Figure 3:
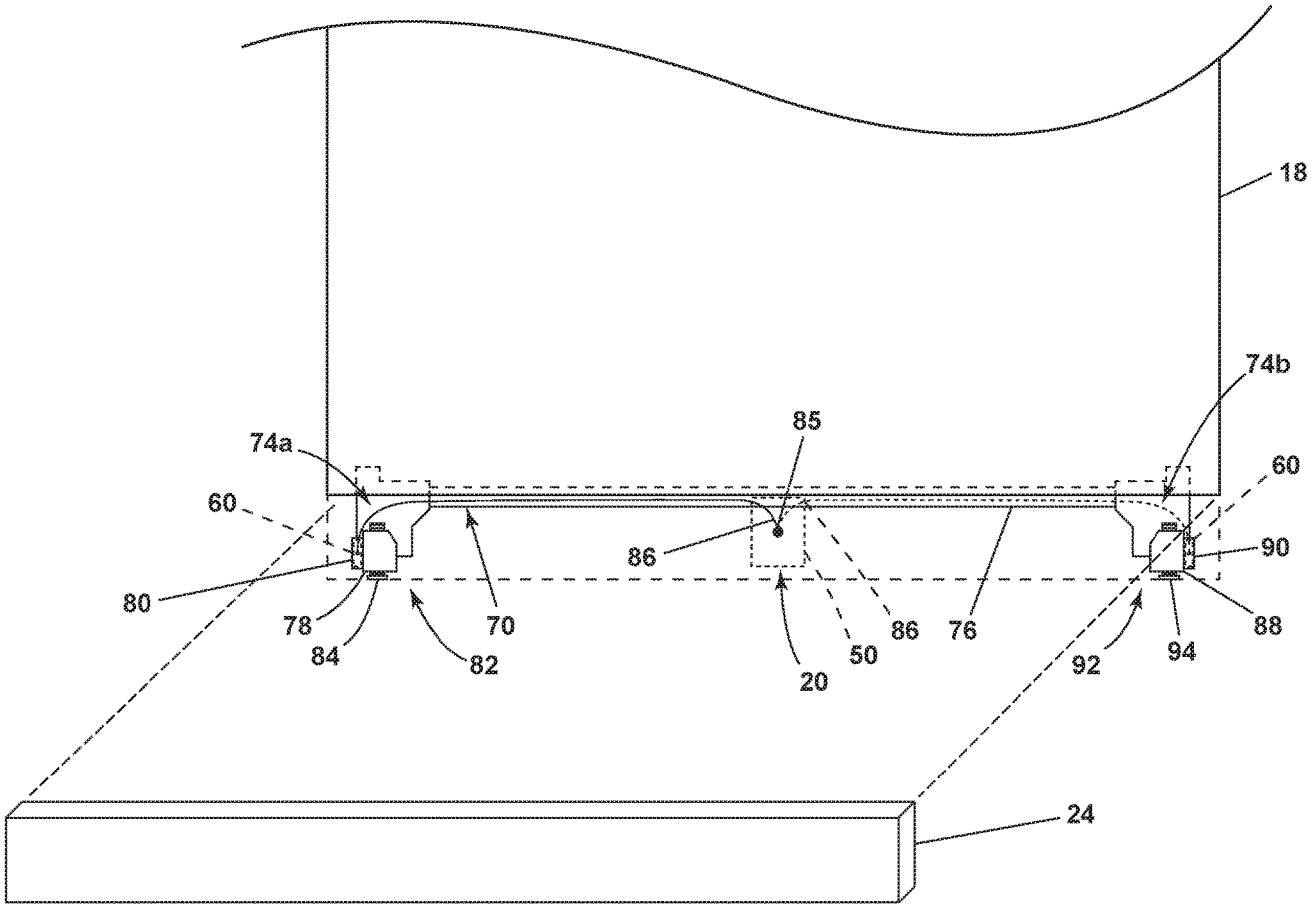
FIG. 3 is a front perspective view of the toe kick area of the dishwasher of FIG. 1, with the toe kick plate exploded for better viewing of a base for the dishwasher.

FIG. 3 is a schematic front view of the dishwasher 10 from FIG. 1 with the toe kick plate 24 removed. The base frame 70 can include a pair of side walls (74*a*, 74*b*) connected by one or more cross bars 76. As illustrated in a non-limiting example, a first side wall 74*a* is located on the left side 82 of the toe kick area 20 and a second side wall 74*b* is located on the right side 92 of the toe kick area 20. The first and second side walls 74*a*, 74*b* can be made of a material that is radio wave transmissive.

A left leg 78 can couple to the first side wall 74*a* located in the toe kick area 20 of the bottom-front 22 of the dishwasher 10. A first wireless communication mount 80 is adjacent to the left leg 78 located at a left side 82 of the toe kick area 20. The left leg 78 can also include a left foot 84 that extends from the left leg 78. The left foot 84 can be used to help level the dishwasher 10. The left leg 78 or the left foot 84 can be made of a material that is radio wave transmissive.

Spaced some distance from the left leg 78, a right leg 88 can couple to the second side wall 74*b* located in the toe kick area 20 of the bottom-front 22 of the dishwasher 10. A second wireless communication mount 90 is adjacent to the right leg 88 located at a right side 92 of the toe kick area 20. The right leg 88 can also include a right foot 94 that extends from the right leg 88. The right foot 94 can be used to help level the dishwasher 10. The right leg 88 or the right foot 94 can be made of a material that is radio wave transmissive.

The wireless communication module 60 can use radio waves to communicate information between the dishwasher 10 and other household wireless communication devices. The wireless communication module 60 can be mounted in the first wireless communication mount 80. A wired connector 86 can electrically connect the wireless communication module 60 to the controller 50. The wired connector 86 can couple to or through the chassis 12 or the base frame 70 at a central location 85 in the toe kick area 20.

Alternatively, the wireless communication module 60 can be mounted in the second wireless communication mount 90 as an alternative to the first wireless communication mount 80. The wired connector 86 can electrically connect the wireless communication module 60 to the controller 50 when the wireless communication module 60 is mounted in the second wireless communication mount 90. The controller 50 can be mounted, as an alternative, to the toe kick area 20. The controller 50 can be located centrally between the left and right sides of the housing whether it is mounted in the toe kick area 20, the door assembly 18, or another part of the chassis 12.

The toe kick plate 24 is illustrated as exploded in FIG. 3 to reveal the toe kick area 20. When the toe kick plate 24 is replaced, left and right legs 78, 88 and the first and second wireless communication mounts 80, 90 will be located behind the toe kick plate 24 as demonstrated in FIG. 1. The toe kick plate 24 is made of a material that is radio wave transmissive.

Figure 4:
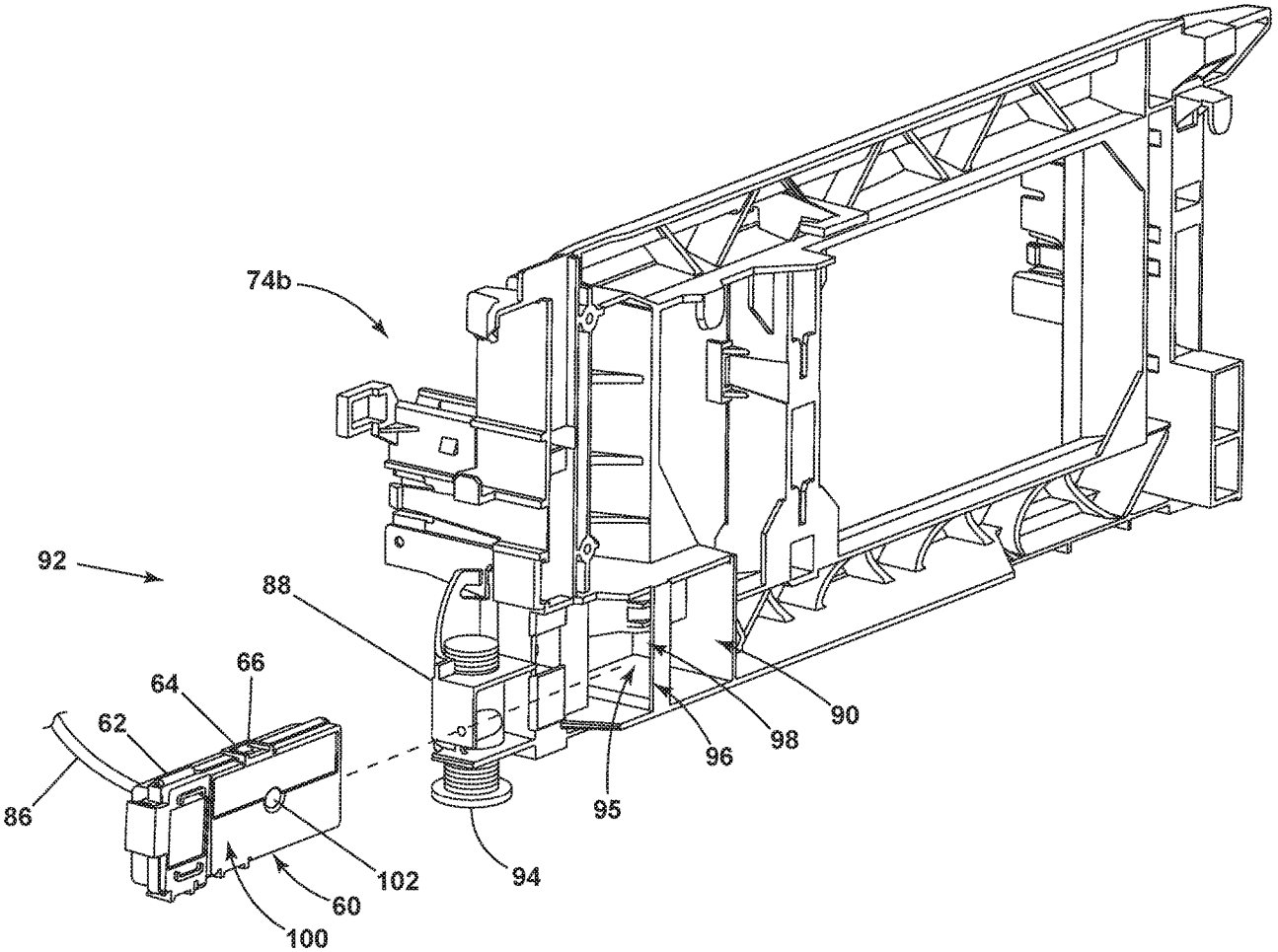
FIG. 4 is a right side perspective view of a portion of the base for the dishwasher of FIG. 1, with a wireless communication module show in a pre-installed position.

FIG. 4 is a close up of the second side wall 74*b* on the right side 92 of the toe kick area 20. The second side wall 74*b* is constructed, molded or cast from a material that is radio wave transmissive, such as a plastic. The right leg 88 can be a portion of the second side wall 74*b* or coupled to the second side wall 74*b*. The right leg 88 can be made of a material that is radio wave transmissive. The right foot 94 can be threaded into the right leg 88 by twisting means. The right foot 94 can couple to the right leg 88 using alternative methods known in the art. The right foot can be made of a material that is radio wave transmissive.

The second side wall second 74*b* can include the second wireless communication mount 90. The second wireless communication mount 90 can be formed as a pocket area 95 defined by the second side wall 74*b* and a brace 96. Alternatively, the second wireless communication mount 90 can form a pocket area that can be coupled to the second side wall 74*b*.

The pocket area 95 is designed to slidably receive the wireless communication module 60. In FIG. 4 the wireless communication module 60 is illustrated as in an unmounted position. The wireless communication module 60 can include a cover 100 made of a material that is radio wave transmissive. The cover 100 can include a recess 102. When slideably mounted into the pocket area 95 of the second wireless communication mount 90, the recess 102 can receive a detent 98 located on the brace 96.

Figure 5:
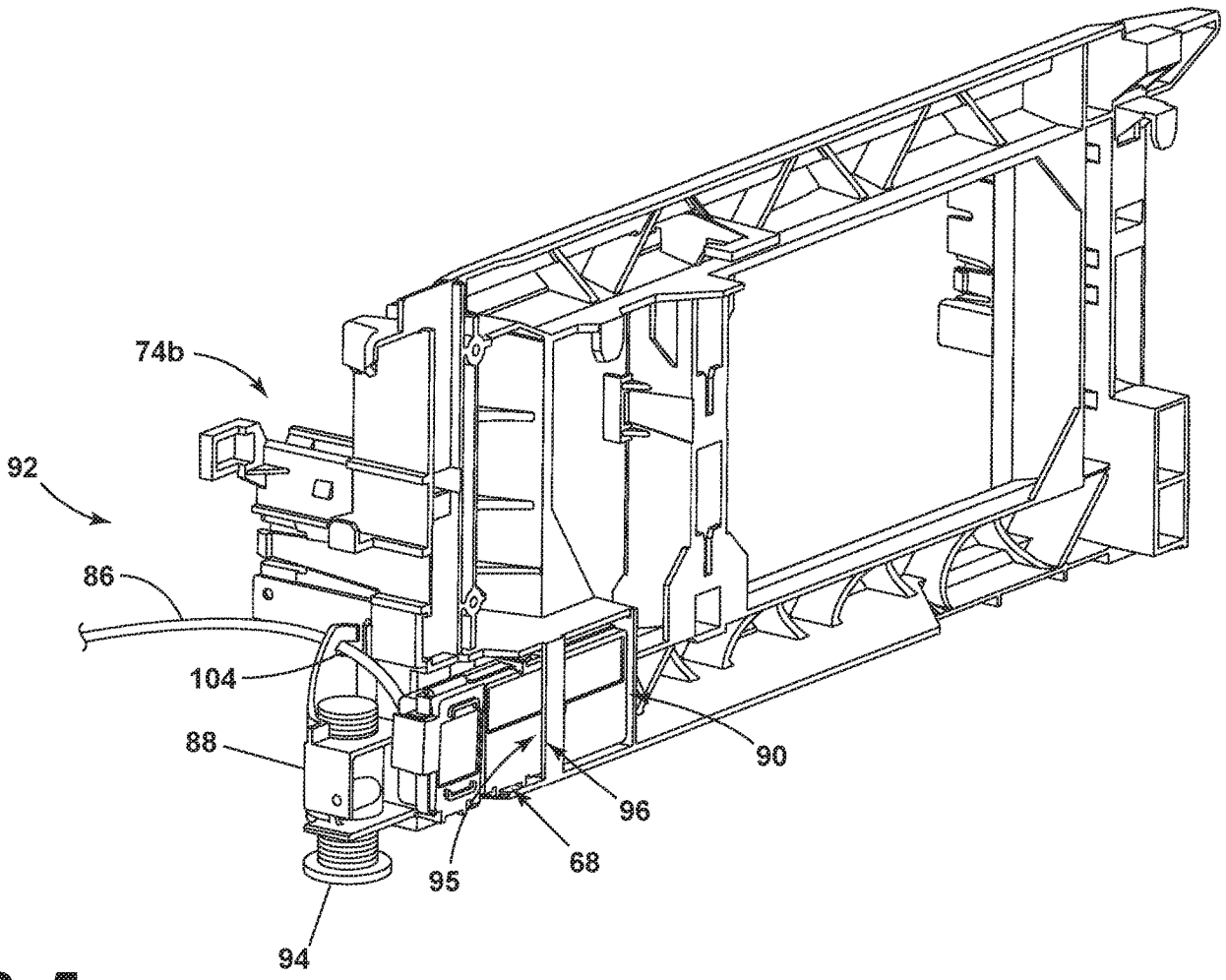
FIG. 5 is a right side perspective view of the portion of the dishwasher of FIG. 4 after the wireless communication module is installed.

FIG. 5 illustrates the wireless communication module 60 inside the cover 100 slidably mounted to into the pocket area 95 of the second wireless communication mount 90. The wireless communication module 60 can be secured to the wireless communication mount 90 by the brace 96. The wireless communication module can be further be secured by the fitting of the detent 98 into the recess 102 (not shown).

The wireless communication module 60 includes the wired connector 86 to communicate with the controller 50. With the wireless communication module 60 mounted to the second wireless communication mount 90, the position of the wired connector 86 can be guided by a hook 104 that is formed as a part of or coupled to the second side wall 74*b*.

While only the right side 92 is illustrated in FIG. 4 and FIG. 5; it is understood that the left side 82 and corresponding components would have the same features in mirror image to those on the right side 92.

Figure 6:
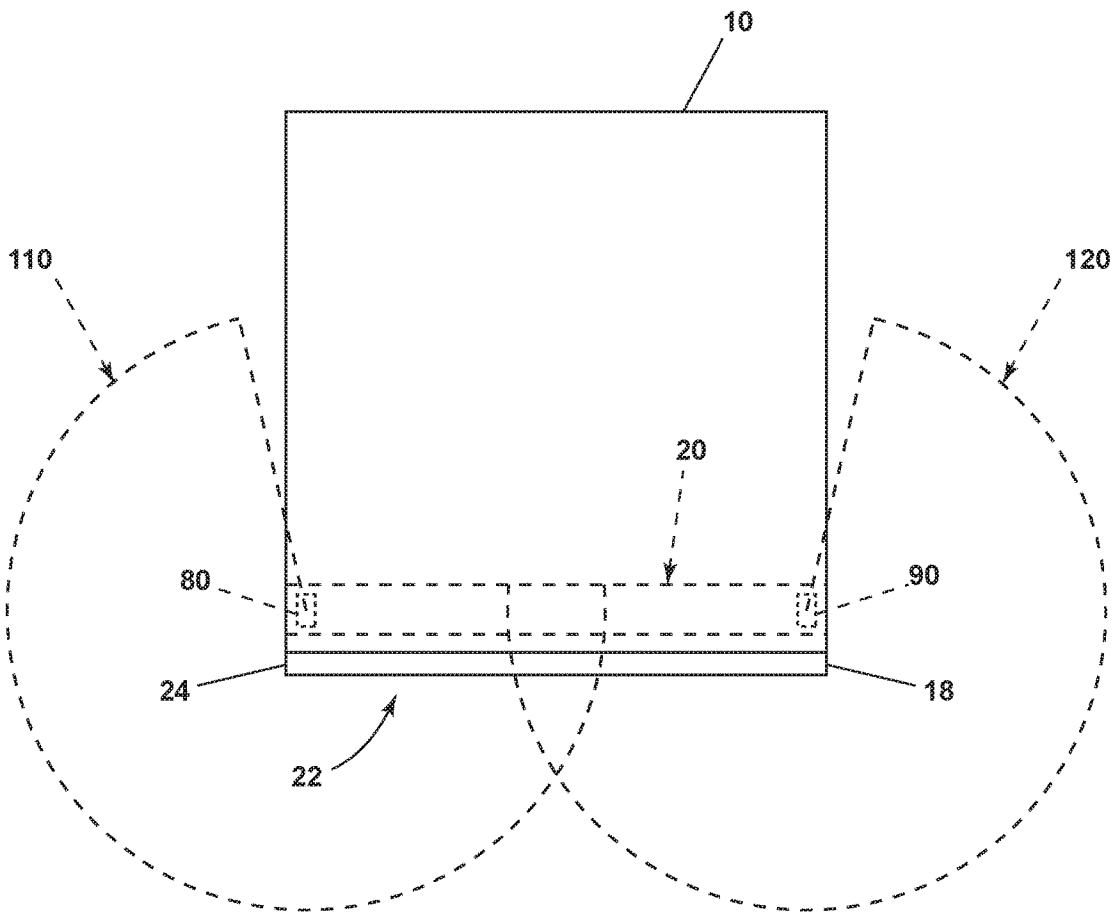
FIG. 6 is a schematic top view of the dishwasher illustrating wireless communication signal ranges.

FIG. 6 illustrates is a schematic top-down view of the dishwasher to graphically demonstrate wireless communication signal regions. When the wireless communication module 60 is selectively mounted in the first wireless communication mount 80, the estimated wireless communication signal range is demonstrated, but limited to, the angle at the first wireless communication mount 80 represented by a first region 110. When the wireless communication module 60 is selectively mounted to the second wireless communication mount 90, the estimated signal range is demonstrated, but not limited to the angle at the second wireless communication mount 90 represented by a second region 120.

Figure 7:
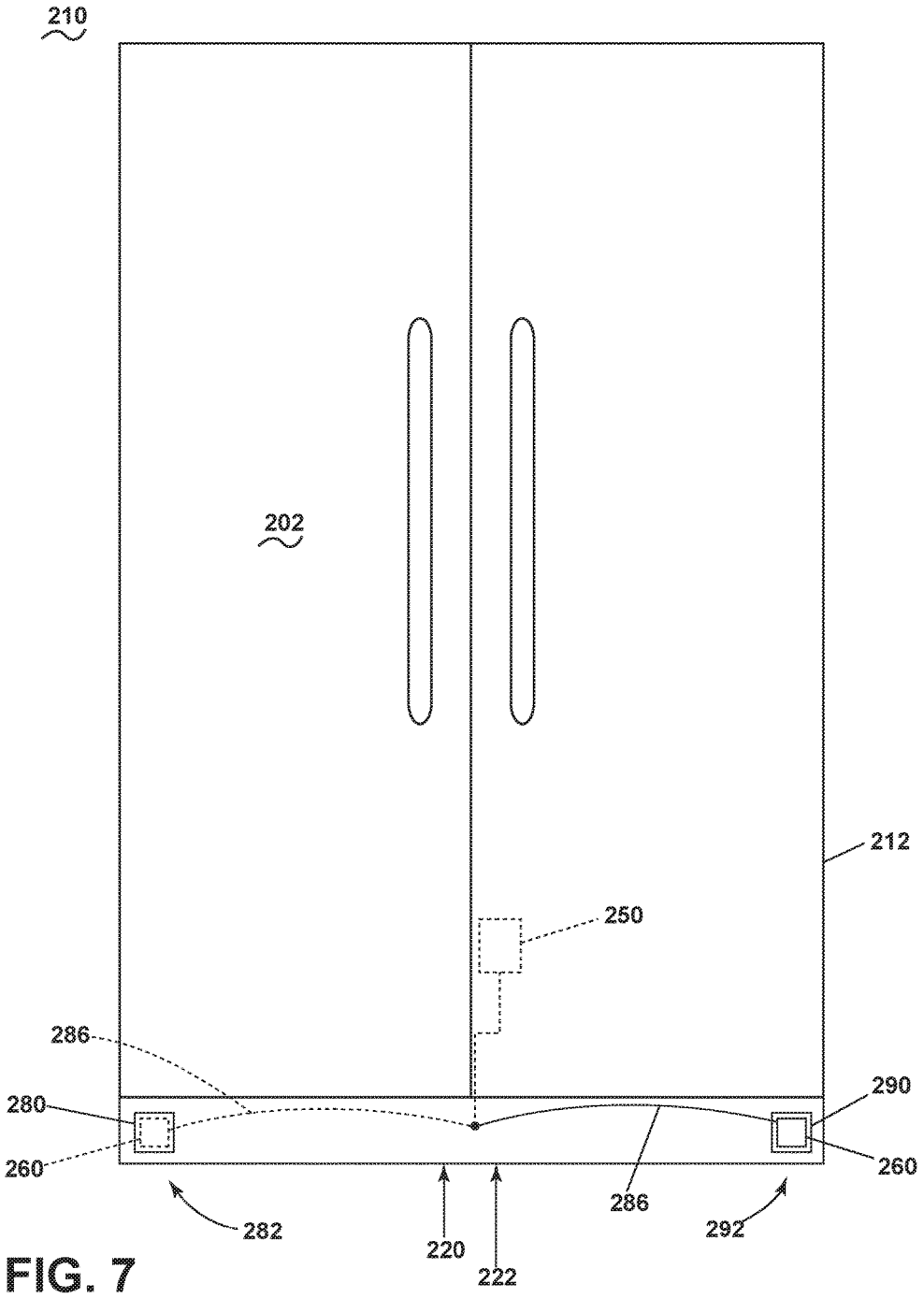
FIG. 7 is a schematic front view of a generic household appliance according to another aspect of the present disclosure.

FIG. 7 illustrates a schematic front view of a household appliance 210 with a housing 212 that defines an interior 202.

The household appliance 210 is substantially similar to the dishwasher 10. Therefore, like parts will be identified with like numerals increased by 200, with it being understood that the description of the like parts of the dishwasher 10 applies to the household appliance 210 unless otherwise noted.

A bottom front 222 of the housing 212 of the household appliance 210 includes a toe kick area 220. At least part of the housing 212 overhangs the toe kick area 220. The household appliance 210 can include a first wireless communication mount 280 located at a left side 282 of the toe kick area 220. The household appliance 210 also includes a second wireless communication mount 290 on the right side 292 of the toe kick area 220. The first and second wireless communication mounts 280, 290, as well as other aspects of the toe kick area 220, can be constructed or cast from a material(s) that are radio wave transmissive.

A controller 250 is located in the interior 202 of the household appliance 210. The controller 250 can communicate with a wireless communication module 260 via wired connector 286. The wireless communication module 260 can include an antenna (not shown). Additionally or alternatively to the antenna, the wireless communication module 260 can include a transmitter or receiver.

The wireless communication module 260 including at least the antenna, can be selectively mounted in the second wireless communication mount 290. Alternatively, the wireless communication module 260 can be removed from the second wireless communication mount 290 and selectively mounted in the first wireless communication mount 280.

The household appliance 210 can be, but is not limited to, a dishwasher, an oven, a refrigerator, a freezer, a microwave, a washing machine, a dryer, or a combo washer-dryer.

In operation, a user or technician can remove the toe kick plate 24 in the bottom-front 22 of the dishwasher 10. Once removed, the toe kick area 20 is accessible. The wireless communication module 60 can be selectively mounted in the first wireless communication mount 80. The first wireless communication mount 80 is located on the left side 82 of the toe kick area 20; adjacent to the left leg 78. The wireless communication module 60 can be coupled to the first wireless communication mount 80 using the alignment of the detent 98 on the brace 96 of the first wireless communication mount 80 and the recess 102 in the cover 100 of the wireless communication module 60. Alternatively or additionally, other clasping or latching techniques can be used to secure the removable wireless communication module 60 to the first wireless communication mount 80. The wired connector 86 can be guided into a proper location using the hook 104. Additionally or alternative, other wire guiding methods can be used to ensure the placement of the wired connector 86.

Once the wireless communication module 60 is mounted in the first wireless communication mount 80, the estimated signal range can be the first region 110.

The user or technician can remove the wireless communication module 60 from the first wireless communication mount 80 and free the wired connector 86 from the hook 104. The user or technician can then selectively mount the wireless communication module 60 in the second wireless communication mount 90. The second wireless communication mount 90 is located on the right side 92 of the toe kick are 20; adjacent to the right leg 88. Similar latching and clasping techniques to those discloses above for the first wireless communication mount 80 can be used to mount the wireless communication module 60 to the second wireless communication mount 90. Similarly, the hook 104, or any acceptable wire guide method can be used to position the wired connector 86. Once the wireless communication module 60 is mounted in the second wireless communication mount 90, the estimated signal range can be the second region 120.

Depending on the geometry of other household appliances, other wireless communication devices, and location of the dishwasher 10, the user or technician can decide which of the first and second wireless communication mounts 80, 90 gives the user the strongest signal.

One advantage of the present disclosure is that with a selectively mountable wireless communication module 60, a much broader region of signal is available without adding one or more additional antennas to the household appliance.

Another advantage of the present disclosure is that the wired connector 86 couples to or through the chassis 12 or the base frame 70 at the central location 85 in the toe kick area 20. This ensures that the communication between the wireless communication module 60 and the controller 50 is maintained as the wireless communication module 60 moves between the first and second wireless communication mounts 80, 90. Moving the wireless communication module 60 from the first wireless communication mount 80 to the second wireless communication mount 90 or vice versa does not require the attachment or detachment of wires; nor the presence of additional wires.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to at least one automatic cycle of operation, the dishwasher comprising:

a tub at least partially defining a treating chamber with an access opening;

a door assembly movable between opened/closed positions to selectively open/close the access opening of the tub;

a toe kick area along a bottom-front of the dishwasher wherein at least a portion of the door assembly overhangs the toe kick area;

a first wireless communication mount located at a left side of the toe kick area;

a second wireless communication mount located at a right side of the toe kick area;

a single wireless communication module comprising a single antenna, the single wireless communication module selectively mountable to either one of the first wireless communication mount or the second wireless communication mount, wherein the selective mounting of the single wireless communication module to either the first wireless communication mount or the second wireless communication mount is selected based on which of the first wireless communication mount or the second wireless communication mount provides a stronger wireless communication signal for the single wireless communication module; and a controller configured to communicate with the single wireless communication module.

2. The dishwasher of claim 1 comprising a toe kick plate located in the toe kick area.

3. The dishwasher of claim 2 wherein the first and second wireless communication mounts are located behind the toe kick plate.

4. The dishwasher of claim 1 further comprising left and right legs at the bottom-front of the dishwasher.

5. The dishwasher of claim 4 wherein the first and second wireless communication mounts are adjacent a corresponding one of the left and right legs.

6. The dishwasher of claim 5 further comprising a left and right foot extending from the left and right legs.

7. The dishwasher of claim 6 wherein at least one of the legs and feet are radio wave transmissive.

8. The dishwasher of claim 4 further comprising a base frame with a pair of side walls connected by cross bars, with the side walls having the first and second wireless communication mounts.

9. The dishwasher of claim 1 wherein the single wireless communication module further comprises a transmitter and receiver.

10. The dishwasher of claim 1 further comprising a wired connector electrically connecting the single antenna directly to the controller.

11. The dishwasher of claim 10 wherein the controller is located centrally between left and right sides of the dishwasher.

12. The dishwasher of claim 11 wherein the door assembly defines a portion of a front of the dishwasher and the controller is located within the door assembly.

13. A household appliance comprising:

a housing defining an interior and having a toe kick area along a bottom-front of the housing and a front overhanging the toe kick area;

a controller located within the interior;

a first wireless communication mount located at a left side of the toe kick area;

a second wireless communication mount located at a right side of the toe kick area; and a single wireless communication module comprising a single antenna, the single wireless communication module selectively mountable to either one of the first wireless communication mount or the second wireless communication mount, wherein the selective mounting of the single wireless communication module to either the first wireless communication mount or the second wireless communication mount is selected based on which of the first wireless communication mount or the second wireless communication mount provides a stronger wireless communication signal for the single wireless communication module; and wherein the controller is configured to communicate with the single wireless communication module.

14. The household appliance of claim 13 comprising a toe kick plate located in the toe kick area.

15. The household appliance of claim 14 wherein the first and second wireless communication mounts are located behind the toe kick plate.

16. The household appliance of claim 13 further comprising left and right legs at the bottom-front of the housing wherein the first and second wireless communication mounts are adjacent a corresponding one of the left and right legs.

17. The household appliance of claim 16 further comprising feet extending from the left and right legs—wherein at least one of the legs and the feet are radio wave transmissive.

18. The household appliance of claim 16 further comprising a base frame with a pair of side walls connected by cross bars, with the side walls having the first and second wireless communication mounts.

19. The household appliance of claim 13 wherein the single wireless communication module further comprises a transmitter and receiver.

20. The household appliance of claim 13 further comprising a wired connector electrically connecting the single antenna directly to the controller.

* * * * *